United States Patent [19]

Jensen, Jr.

[11] 4,290,157

[45] Sep. 22, 1981

[54] COLLAPSIBLE BOAT

[76] Inventor: Ragnar Jensen, Jr., Sundlia 6A, N-1315 Nesöya, Norway

[21] Appl. No.: 10,360

[22] Filed: Feb. 8, 1979

Related U.S. Application Data

[63] Continuation-in-part of Ser. No. 912,866, Jun. 5, 1978, abandoned.

[30] Foreign Application Priority Data

Sep. 24, 1976 [CA] Canada ..... 262026

[51] Int. Cl.[3] ..... B63B 7/00

[52] U.S. Cl. ..... 9/2 C; 9/1.4; 135/15 PQ

[58] Field of Search ..... 9/2 C, 2 R, 2 S, 2 F, 9/6 S, 6 P, 1.4, 6 R; 403/229, 109, 166, 391, 397, 398, 399; 135/15 PQ, DIG. 9; 114/83

[56] References Cited

U.S. PATENT DOCUMENTS

| | | | |
|---|---|---|---|
| 381,137 | 4/1888 | Hodges | 403/391 |
| 507,439 | 10/1893 | King | 9/2 C |
| 1,920,130 | 7/1933 | Pease et al. | 403/399 |
| 2,053,755 | 9/1936 | Wilcox | 9/2 C |
| 2,589,087 | 3/1952 | Jarvi | 9/2 C |
| 3,004,370 | 10/1961 | Tinnerman | 403/397 X |
| 3,070,816 | 1/1963 | Lewis | 9/2 C |
| 3,383,719 | 5/1968 | Van Der Heide | 9/2 C |
| 3,755,063 | 8/1973 | Massey et al. | 9 6 P/ |
| 3,834,410 | 9/1974 | Leibel | 135/15 PQ |
| 3,869,743 | 3/1975 | Brown et al. | 9/2 C |
| 3,932,049 | 1/1976 | Hirato | 403/397 |
| 4,110,951 | 9/1978 | Padrum | 403/399 |
| 4,124,910 | 11/1978 | Raymond | 9/2 C |

FOREIGN PATENT DOCUMENTS

| | | | |
|---|---|---|---|
| 245591 | 11/1969 | U.S.S.R. | 9/2 R |

*Primary Examiner*—J. D. Miller
*Assistant Examiner*—Reinhard J. Eisenzopf
*Attorney, Agent, or Firm*—Schwartz, Jeffery, Schwaab, Mack, Blumenthal & Koch

[57] ABSTRACT

A collapsible boat comprising a first longitudinal main beam terminating in an upwardly bow and stern member; a plurality of longitudinal rib members forming the gunwales and the stringers. The ends of the gunwales and stringers are joined in opposed pairs and each joined pair is held under tension in bracket members provided on the bow and stern members respectively of the main beam member. A plurality of transverse formers are spaced apart and include U-shaped members for retaining the gunwales and stringers in the proper spaced-apart position and a skin extends across the so-formed skeleton and is attached to the gunwales. All of the stringers and gunwales are made of detachable, separate, elongated, tubular members.

8 Claims, 9 Drawing Figures

Fig. 4
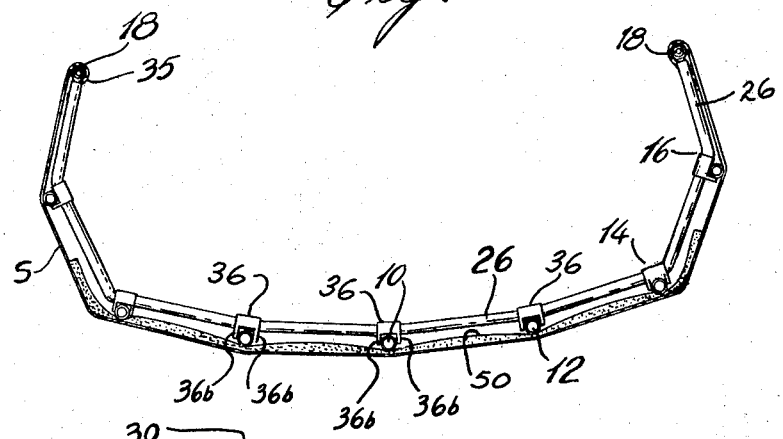
Fig. 5
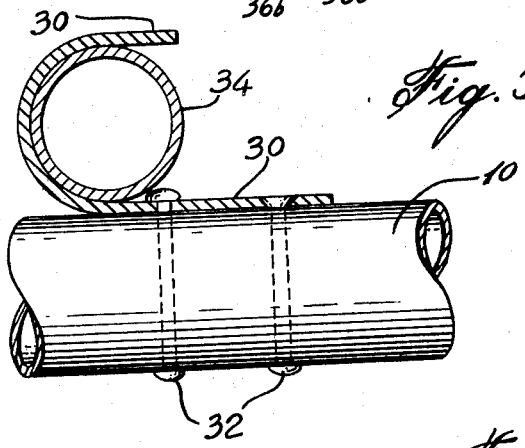
Fig. 7
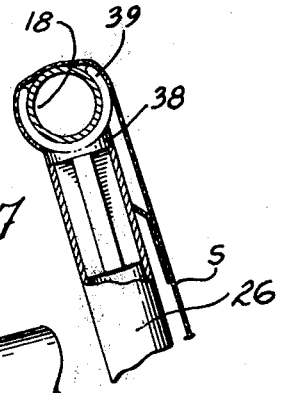
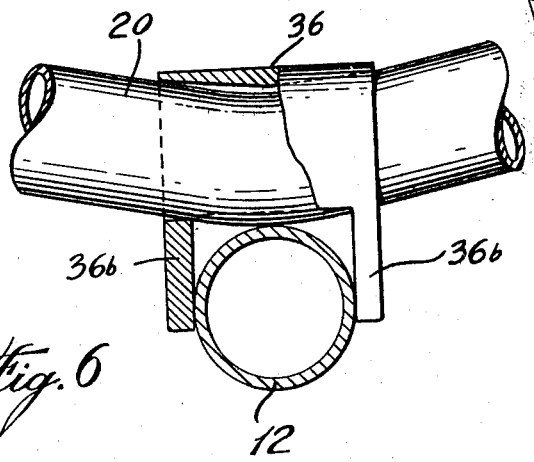
Fig. 6

COLLAPSIBLE BOAT

CROSS-REFERENCE TO RELATED APPLICATION

This application is a continuation-in-part of application Ser. No. 912,866, filed June 5, 1978 now abandoned.

BACKGROUND OF THE INVENTION

1. Field of the Invention

The present invention relates to a boat, and more particularly, to a collapsible canoe.

2. Description of the Prior Art

The canoe is basically a structure having longitudinal ribs and laterally extending cross ribs forming the skelton of the body thereof with a skin of water-proof material about the skeleton. When Europeans first arrived at North America, they found North American natives using such boats wherein the ribs were made of tree branches and the skin stretched over the skeleton was birch-bark. The joints of the birch-bark canoe were sealed with natural gums from the available trees. Since then, such canoes have been made commercially using wood skeletons and canvas skins which were impregnated with a rubber-like, water-proof material, and in recent years aluminium skeletons have been developed with a rigid fiberglass skin.

Collapsible type boats, such as collapsible canoes, have been known, such as in U.S. Pat. No. 1,614,280 to Churchill, 1927, and British Pat. No. 844,197 to Jones, 1960. However, as shown in the type of collapsible canoe described by Churchill, a plurality of different functional pieces is required such as in the bow or stern, in order to hold the longitudinal ribs in position. In the case of Churchill, separate end members are provided fitting in a block which is also adapted to receive the longitudinal ribs under tension. It is believed that the various clamping devices as shown in the Churchill patent, as well as the separate bow and stern blocks, leave a lot to be desired as far as easy assembly or disassembly of the collapsible boat, and does not improve the compactability of the once collapsed boat.

The British patent shows a boat of wooden construction in which certain of the wooden members are hinged together and/or clamped together by spring clamps. Again, the various components making up the boat does not enhance the compactability thereof and make carrying of the boat considerably difficult.

SUMMARY OF THE INVENTION

It is an aim of the present invention to provide a boat of simple light construction with the fewest number of parts, but which can easily be assembled without any tools and which, when disassembled, provides compact, light packages.

A collapisble boat in accordance with the present invention includes a first longitudinal spine member terminating in upwardly curved bow and stern members, a plurality of longitudinal rib members forming the gunwales and stringers, the ends of the gunwales and stringers being joined in opposed pairs and each joined pairs are held under tension in brackets provided on the bow and stern members, respectively, of the main beam member; a plurality of transverse formers spaced apart including means for retaining the gunwales and stringers in a proper spaced-apart position and a skin extending across the so-formed skeleton and attached to the gunwales.

In a more specific embodiment of the present invention, each of the main beam gunwales and stringers is made of sections of detachable separate elongated members adapted to be telescopically engaged end-to-end.

BRIEF DESCRIPTION OF THE DRAWINGS

Having thus generally described the invention particular reference will now be made to the accompanying drawings, wherein:

FIG. 4 is a vertical cross-section taken on line 4–4 of FIG. 1;

FIG. 5 is an enlarged fragmentary view of a detail of a bracket circled in FIG. 3;

FIG. 6 is an enlarged fragmentary view partly in cross-section of another bracket circled in FIG. 4;

FIG. 7 is an enlarged fragmentary view partly in cross-section of a detail of still another bracket circled in FIG. 4;

DESCRIPTION OF THE PREFERRED EMBODIMENT

Figure 1:
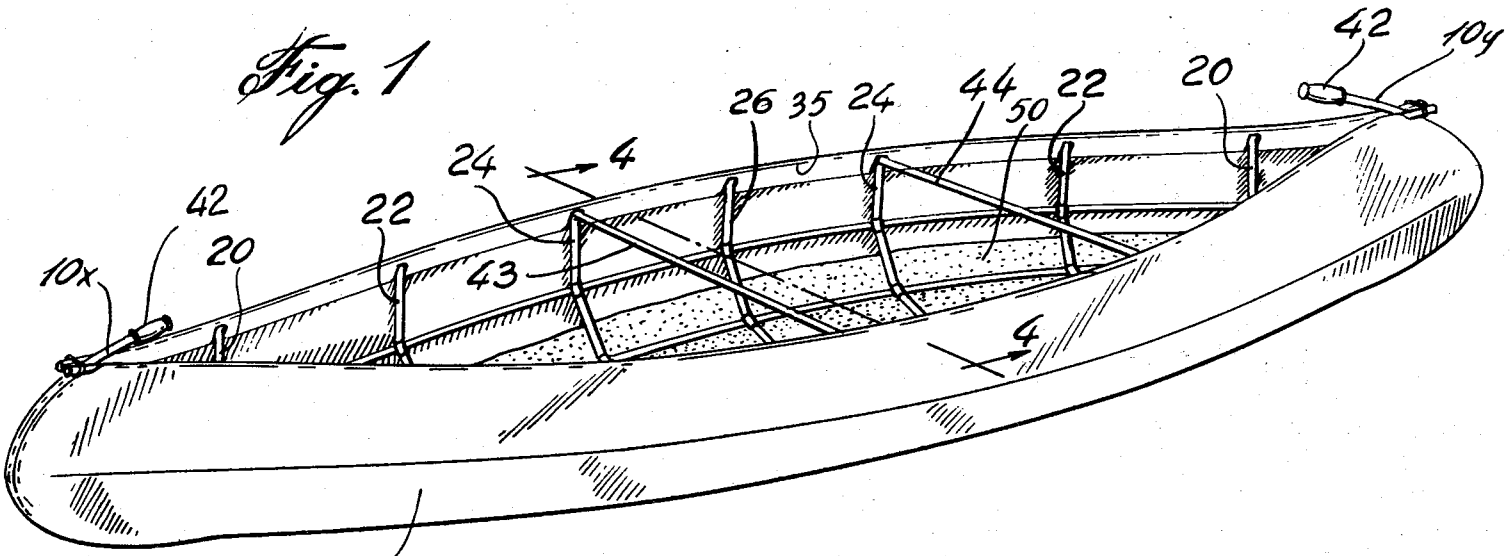
FIG. 1 is a perspective view of a canoe constructed in accordance with the present invention.
Figure 8:
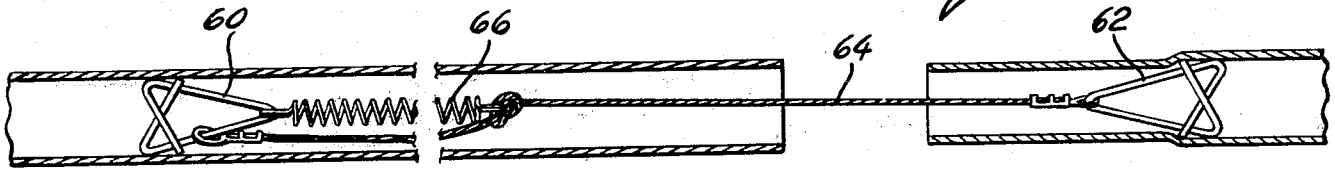
FIG. 8 is a fragmentary cross-sectional view of one embodiment of the end-to-end attachment of the tubular member of the boat.
Figure 2:
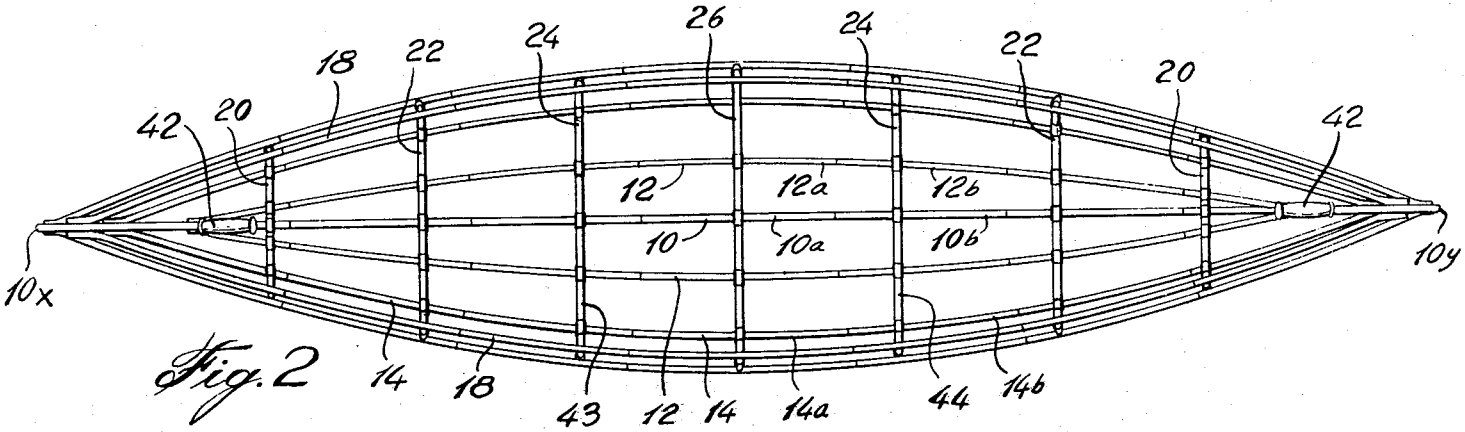
FIG. 2 is a top plan view of the canoe without the skin thereon.
Figure 3:
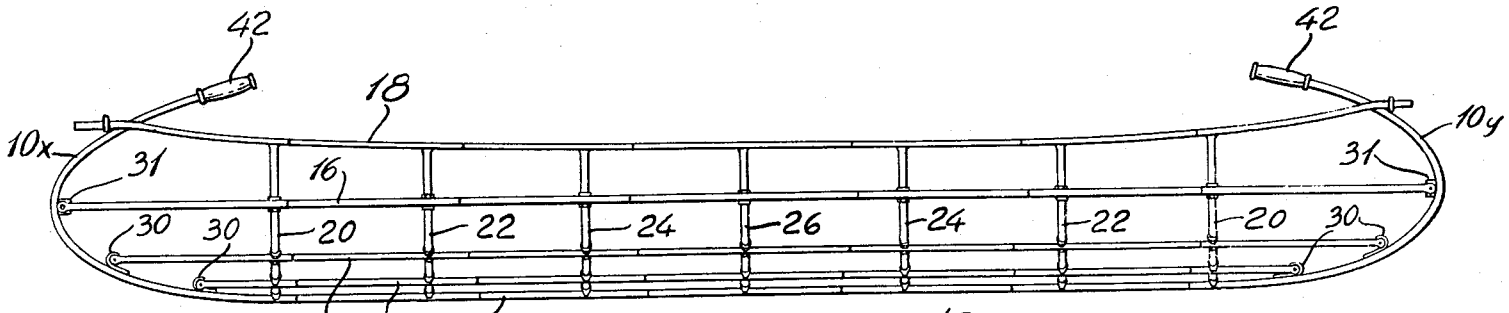
FIG. 3 is a side elevation of the skeleton of the canoe shown in FIG. 2.

Referring now to the drawings and particularly to FIGS. 1, 2 and 3, there is shown a canoe having a main beam member 10 made up of detachable end-to-end sections 10*a*, 10*b*, including a bow member 10*x* and a stern member 10*y*; a number of elongated longitudinal ribs form stringers 12 and are also made up of individual detachable end-to-end sections 12*a*, 12*b*. The other stringers are numbered 14 and 16, respectively. Further, similar elongated members made up of detachable end-to-end sections form the gunwales 18. Transverse formers 20, 22, 24, 26 maintain the shape of the stringers and gunwales forming the canoe. Finally, a skin S having channels 35 sewn therein is stretched about the frame or skeleton of the canoe. The channels 35 include openings coinciding with the ends of formers 22, 24, 26. Each of the elongated members, such as the beam 10, stringers 12, 14 and 16, and the gunwale, is made up of end-to-end disconnectable sections. Each section, as shown in FIG. 8, has a portion of smaller diameter at one end thereof and the other portion of constant diameter and adapted to engage over the portion of small diameter. In each of the ends is provided a wire-shaped anchor 60 and 62. A wire 64 extends between both anchors, and a spring 66 tends to draw the ends of the members together since it is attached to the wire 64, as shown in FIG. 8, and to one of the anchors, in this case, anchor 60.

Referring now to FIG. 5, there is shown a C-shaped hook clamp 30 which is fixed to a portion of the main beam 10 at the bow section 10*x* and stern section 10*y* by rivets or fasteners 32; a stub member 34 would normally extend between the ends of each pair of stringers 12 or 14 and the stub 34 would be engaged by the hook clamp 30 holding the stringers 12 or 14 both under tension.

The stingers 16 meet the bow and stern sections 10*x* and 10*y* of the main beam 10 almost perpendicularly. Accordingly, a U-shaped clamp 31 can be used which engages the stub member 34 extending between the ends of the stringers 16.

The gunwale 18, however, sandwiches the bow member 10*x* and stern member 10*y* and can be tied with a suitable loop. Each of the formers 20, 22, 24 and 26 are provided with U-shaped members 36 which engage a typical stringer 12. The U-shaped members 36, which may be molded plastics pieces, retain the various stringers 12, 14 and 16 in position relative to the formers 20, 22 and 24, 26, that is, spaced apart from each other. Each U-shaped member includes a sleeve 36*a* adapted to fit on the tube forming the former. A pair of legs 36*b* extend at right angles to the axis of the sleeve and can engage the stringers 14 and 16.

The upper ends of the formers 20, 22 and 24, 26 can be provided with an insert 38 having a U-shaped portion 39 in which the gunwale members 18 can be seated. The gunwale members may be equipped with two plastic rings which the U-shaped portion is placed between, preventing it from gliding on the gunwale. All of the end-to-end sections may be made of tubular, lightweight, cylindrical pipe, preferably of aluminium material.

A handle grip means 42 may be provided at each end of the bow and stern members 10*x* and 10*y* so as to provide for easy carrying or portage of the canoe when it is assembled.

A mat 50 is provided in the bottom of the finished boat. The mat 50 can be a soft closed cell foamed plastics material which can help to float the boat in the event it capsizes. The mat is suitably shock-absorbing and thus reduces damage on the skin. Mat 50 is illustrated in both FIGS. 1 and 4.

In assembling the structure, the skin S is laid on the ground and the bow and stern members 10*x* and 10*y* are located in each end of the skin in an upright position. The main beam sections 10*a*, 10*b* etc., are then connected end-to-end and fitted into each of the bow and stern members 10*x* and 10*y*, respectively. The stringers 16 are then assembled end-to-end and their stub members are then engaged within the U-shaped brackets 31 at the bow member 10*x* and stern member 10*y*, respectively. Once the stringers are so placed, they will be tensioned into a bowed curve, against the skin S. The remaining stringers are then similarly assembled and the ends thereof, i.e., the stub members extending between the ends thereof, are hooked into the hook-shaped brackets 30 at each end, that is, at the bow and the stern.

The sections of the gunwales are inserted within the channel 35 formed in the skin S and are then assembled end-to-end and attached to the bow and stern members 10*x* and 10*y* respectively. Formers 20, 22 and 24, 26 are then located by first inserting therein U-shaped portion 39 in the upper ends 38 thereof into which the gunwales 18 are seated. The stringers are at the same time arranged so that they fit within the U-shaped prongs 36 of the formers 20, 22 and 24, 26. Finally, a pair of cross members 43 and 44, as shown in FIG. 1, can be located to keep the gunwales and the formers spread apart.

The skin S may be made of polyester reinforced with nylon and laminated by polyvinylchloride, or alternatively the skin S may be made of polyvinylchloride reinforced with polyester threads in the bottom and polyvinylchloride reinforced with threads of polyamide in the sides.

Figure 9:
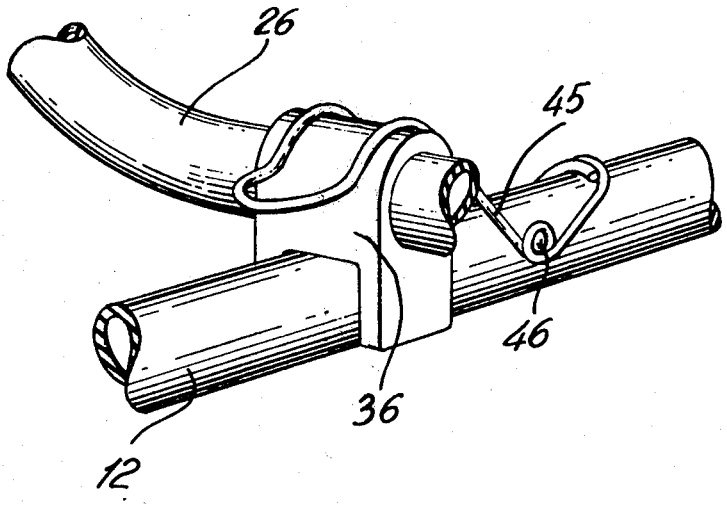
FIG. 9 is a fragmentary view of a detail of the canoe at the intersection between a stringer and a former, and represents a modification of FIG. 6.

Referring now to FIG. 9, there is shown an S shaped spring-tensioned hook clamp 45 which is attached to a portion of the stringers 12 by rivets or fasteners 46, and a transverse former 26 with its U-shaped prong 36 is held under the hook clamp 45.

I claim:

1. A collapsible boat comprising a skeleton and water-impervious skin held in tension against the skeleton, the skelton comprising:

(a) a longitudinal main beam terminating in upwardly curved bow and stern sections, (b) a pair of gunwale members and a plurality of stringers extending from the stern to the bow section, and (c) a plurality of formers extending laterally of the beam and spaced apart longitudinally, (d) each of the gunwales, stringers and main beam being assembled from a plurality of lightweight metallic tubular sections, (e) each section having one end retainably inserted into the other end of the next section making up the gunwale, stringer and beam, (f) the ends of each gunwale and stringer on one side of the longitudinal beam being connected to the end of the corresponding gunwale and stringer on the other side of the beam by individual connectors each having at least a stub cylindrical portion, (g) each former including a lightweight metallic tubular member in the form of a U, (h) the stern and bow sections of the main beam each being provided with open C-shaped brackets for receiving respective stub cylindrical portions of connectors of respective pairs of stringers and gunwales, (i) a plurality of open, downwardly directed U-shaped brackets positioned on the formers, the stringers and gunwales being bowed outwardly when assembled and being held on the outer surface of the formers in a laterally spaced-apart relation by the open U-shaped brackets fixed at corresponding locations on each former, (j) wherein the skin under tension over the skeleton holds the stringers and main beam against the formers and within the open U-shaped brackets.

2. A boat as defined in claim 1, wherein a soft closed cell foam plastics mat underlays the stringers and beam against the surface of the skin forming the bottom floor.

3. A boat as defined in claim 1, wherein the skin is a polyester material reinforced with polyamide and laminated with polyvinylchloride.

4. A boat as defined in claim 1, wherein the skin in the bottom of the boat is made of polyvinylchloride reinforced with polyester threads and in the sides of the boat is made of polyvinylchloride reinforced with polyamide.

5. A collapsible boat as defined in claim 1, wherein each gunwale, stringer and beam section includes within the tubular end thereof an anchor, retaining means between the anchors of respective ends of the sections, and resilient means normally urging the ends together.

6. A collapsible boat as defined in claim 1, wherein the brackets on the formers for retaining the ribs in a spaced-aprt position include a sleeve member adapted to the fitted onto the tubular member forming the former, and a pair of legs defining a U adapted to receive the tubular stringer therebetween.

7. A collapsible boat as defined in claim 1, wherein an S-shaped spring-tensioned hook clamp is attached to a stringer and engages a transverse former by clamping it to said stringer.

8. A collapsible boat as defined in claim 1, wherein the open U-shaped brackets for retaining the gunwales include a stern portion insertable in the open end of the tubular former and a pair of legs forming the bracket and adapted to receive the tubular gunwale.

* * * * *